US006151713A

United States Patent [19]

Dunn

[11] Patent Number: 6,151,713

[45] Date of Patent: Nov. 28, 2000

[54] HAND PROTECTOR

[76] Inventor: Becky R. Dunn, 1301 Horine Rd., Festus, Mo. 63028

[21] Appl. No.: 09/369,869

[22] Filed: Aug. 9, 1999

[51] Int. Cl.[7] ..... A41D 13/08

[52] U.S. Cl. ..... 2/16; 2/17; 269/7

[58] Field of Search ..... 2/16, 17, 20, 455, 2/159, 160, 18, 161.8, 161.1; 15/104.94, 227; 269/7; 81/125

[56] References Cited

U.S. PATENT DOCUMENTS

| | | | |
|---|---|---|---|
| 2,497,749 | 2/1950 | Wagner | 2/16 |
| 3,746,356 | 7/1973 | Shipstad | 2/16 |
| 3,874,686 | 4/1975 | Shipstad et al. | 2/16 |
| 4,361,912 | 12/1982 | Arthur | 2/18 |
| 5,074,173 | 12/1991 | Cearley | 81/125 |

*Primary Examiner*—John J. Calvert
*Assistant Examiner*—Tejash Patel
*Attorney, Agent, or Firm*—Polster, Lieder, Woodruff & Lucchesi, L.C.

[57] ABSTRACT

A hand protector includes a cup open at a bottom end and of the size to admit a hand, a handle within the compass of said cup, the handle being of a size to be grasped by the hand, the handle being hollow for at least part of its length, with an open mouth opening through an otherwise closed top end of the cup, and a plug of pliable material in the mouth. The pliable material is of a consistency and axial length such as to receive and removably to hold the stem of a pyrotechnic device, such as a sparkler or punk stick, or even a long match.

14 Claims, 2 Drawing Sheets

HAND PROTECTOR

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The sparkler is one pyrotechnic device that is considered reasonably safe for handling by children. However, the sparks emitted by sparklers can result in blisters, and the wire handle can become hot enough to burn the skin of a child or at least to cause the child to drop the sparkler. Punk, on a thin stick, is also a source of some danger to children, because it is often not immediately apparent where the hot part of the punk is. In lighting gas water heaters or the like, it is frequently necessary to stick one's hand into the burner area in which the pilot light is to be lighted, and on occasion, if gas has accumulated, the introduction of a lighted taper may cause a blow-back that is liable to singe the hand of the person trying to light the pilot light.

One of the objects of this invention is to provide a protective device for the hand of the person holding a pyrotechnic device such as a sparkler, punk, or match, which can be reused again and again.

Other objects will become apparent to those skilled in the art in light of the following description and accompanying drawing.

In accordance with this invention, generally stated, a hand protector includes an inverted cup, open at a bottom, and of a size to admit a hand, and a handle within the compass of the cup, the handle being of a size to be grasped by the hand. The handle is hollow through at least a portion of its length, has a closed part and an open part with a mouth opening through a top end of the cup, and, in the preferred embodiment, a plug of pliable material in the mouth. The pliable material is of consistency and axial length such as to receive and securely but removably to hold the stem of a pyrotechnic device. In the preferred embodiment, the handle extends to a point above the plane of the bottom of the cup, and the pliable material is of a character of Poster Putty® or Handi-Tak®, commercially available products. The plug of such pliable material is largely self-healing, and is capable of holding a stem securely but removably, again and again. Preferably, the handle has in it a stop, which can be in the form of a disk or plug. The stop serves to limit the depth to which the stem of the sparkler or the like can be inserted, so as to leave enough projecting stem below the sparkler material to permit the ready insertion of the wire stem of the sparkler without engaging the pyrotechnic material, and once the material has burned, after a suitable length of time, to permit the spent sparkler to be removed with a minimum of danger to the fingers of the person removing it.

Because the handle is shorter than the distance from the top of the cup to the open edge, the cup can be used as a stand, as well as a hand protector, to permit a punk, for example, to be set up and firecrackers lit from the burning punk. As is apparent, if the device is used to hold a taper, the danger to the hand and forearm of the user, in lighting a gas appliance, is minimized. In the preferred embodiment, the cup and handle are made in one piece, from a plastic such as polyethylene or polypropylene, with a substantially uniform wall thickness, and the stop is an insert in the handle.

DESCRIPTION OF THE PREFERRED EMBODIMENT

Figure 2:
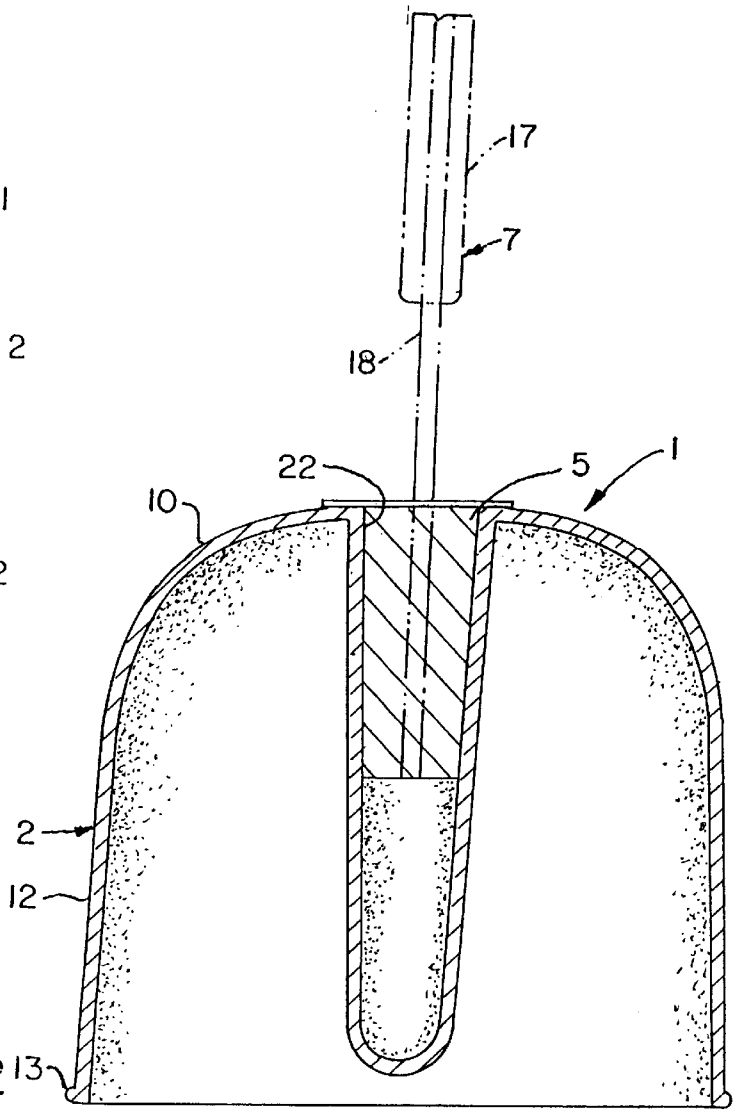
FIG. 2 is a sectional view of the device taken along the line 2.2 of FIG. 1, with a sparkler, shown fragmentarily, installed.

Referring now to the drawing for one illustrative embodiment of the protector of this invention, reference numeral 1 indicates the completed device, which includes an inverted cup 2, a handle 3, a stop 4, and a plug of pliable material, such as Handi-Tak or Poster Putty, the former being a product of Pacer Technology, 9240 Santa Anita Avenue, Rancho Cucamonga, Calif., and the latter of Manco, Inc., 830 Canterbury Road, West Lake, Ohio. Cup 2 has a domed top 10 and a side wall 12 which flares divergently from the domed top to a bottom edge flange or bead 13. In the illustrative embodiment shown, a sparkler 7, with pyrotechnic material 17 and a wire stem 18, is inserted into and held by the pliable material 5. The lower end of stem 18 engages the stop 4, to provide an exposed portion of the stem below the pyrotechnic material 17 between the pyrotechnic material 17 and the outer surface of the pliable material 5.

The handle 3 has a side wall 20 that tapers convergently toward a rounded bottom 21 from a mouth 22.

The cup and handle are made in one piece. In accordance with good molding practice, the walls of the cup and of the handle are made of substantially the same thickness, and, to provide a stop, a plug 4 is secured in the handle. Alternatively, the bottom of the handle can be left open, the interior side wall of the handle made substantially straight at its lower part, and the stop formed integrally with the side wall in the molding process.

Figure 1:
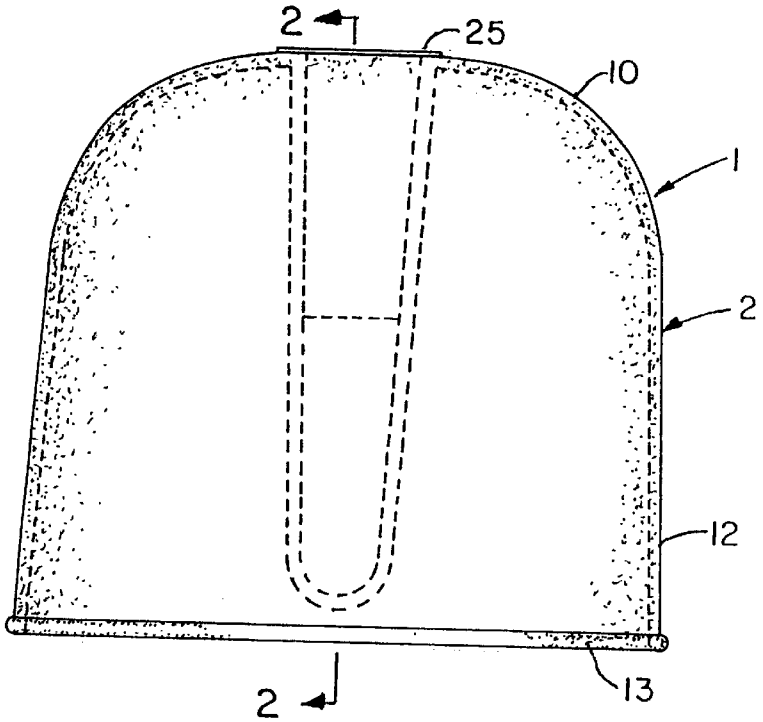
FIG. 1 is a view in side elevation of one illustrative embodiment of the invention.
Figure 3:
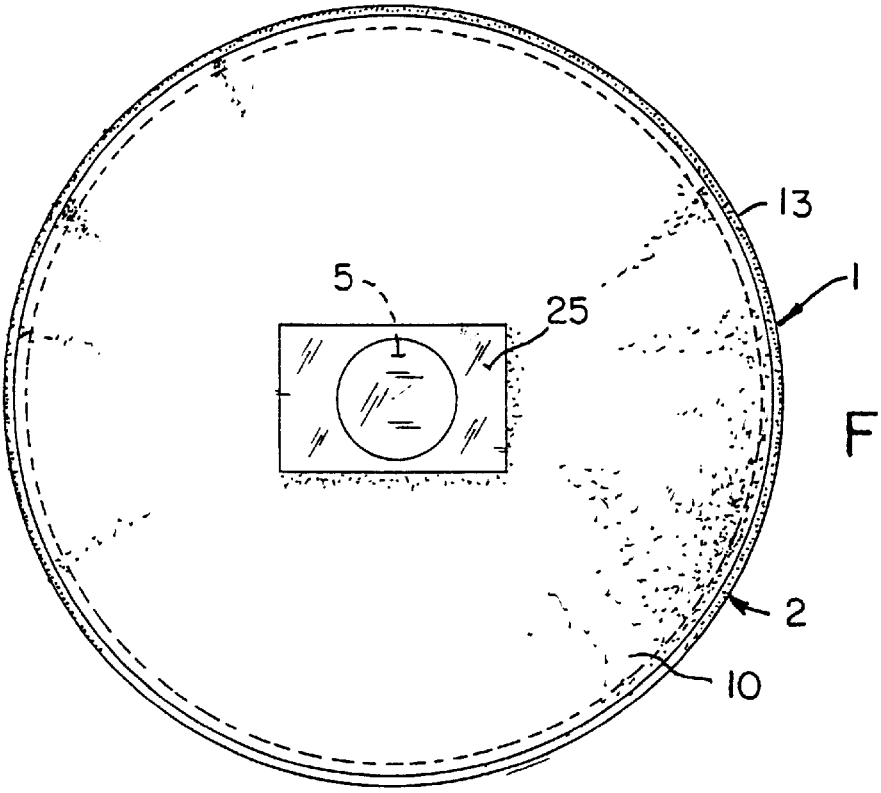
FIG. 3 is a top plan view.
Figure 4:
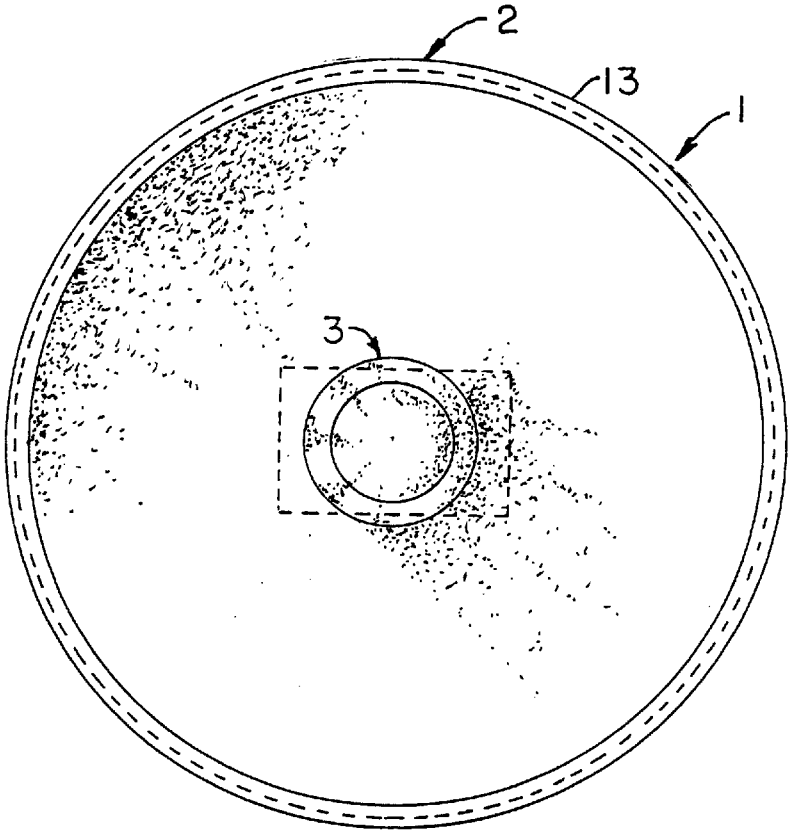
FIG. 4 is a bottom plan view.

As can be seen from FIGS. 1 and 2, because the handle 3 ends above a plane defined by the bottom edge of the cup, the cup can rest on a flat surface, so that a punk stick, for example, can be mounted in the pliant material 5, and the cup placed somewhere where the punk can be readily used. If the bottom edge of the cup is formed to provide three points of contact about 120 degrees apart, those points will define a plane regardless of irregularity in the surface on which the cup is placed.

A keeper 25, in the form of a strip of cellophane or the like, preferably overlies the pliant material when the device is not in use, to protect the pliant material from dirt and to keep it from drying out. The strip is removed when the device is to be used, and can be replaced when the device is to be stored.

In the preferred embodiment, the wall thickness can be about 1/16 of an inch, and the cup made of high impact polyethylene or polypropylene. The outside diameter of the cup at its open edge, including the bead 13, can be about 3⅞ inches, and the inside diameter 3 11/16. The cup can be about 3¼ inches high, and the handle about 3 inches long, and about ⅝ of an inch in diameter at its open mouth. The stop can be about 1½ inches from the mouth.

Numerous variations in the construction of the protector of this invention, within the scope of the appended claims, will occur to those skilled in the art, in the light of the foregoing disclosure. For example, the dimensions given are merely illustrative, and can be varied to suit the manufacturer or the application. The cup itself can be polygonal or elliptical, for example, rather than circular at its base. The material from which the cup is made can be different from polyethylene or polypropylene, such as PVC. It can even be made of metal or fine metal mesh. The means for holding the stem of the pyrotechnic material can be a spring clip of a size to receive the stem and hold it fast. However, such a clip would require that the handle be made to provide a bore small enough to minimize wobbling of the stem. Similarly, a rubber insert, with a bore slightly smaller than that of the stem, can be used, but it is not as versatile as the pliable material, and, with use, is not as likely to be as dependable. The pliable material can be different from Poster Putty or Handi-Tak, or a product of DAP, Inc. sold under the trademark Fun Tak, so long as it is capable of holding the stem of a pyrotechnic device securely, is substantially self-healing, non-toxic and durable. The keeper can be of any material, as long as it is reusable, compatible with the pliant material and adherent enough to the pliant material to remain in place, but not so as to pull out any of the pliant material. A sleeve-like extension, of cloth or other pliant material, can be attached, to provide additional protection for the arm of the user. These variations are merely illustrative.

What is claimed is:

1. A hand protector comprising an inverted, self-supporting, substantially rigid cup, open at a bottom edge, of a size to admit a hand, a handle within the compass of said cup, said handle being of a size to be grasped by said hand, said handle being hollow through at least a portion of its length, having a closed part and an open part with a mouth opening through a top part of said cup, and a plug of pliable material in said mouth, said pliable material being made from a moldable putty and being of a consistency and axial length such as to receive and removably to hold the stem of a pyrotechnic device.

2. The protector of claim 1 including an interior stop within said handle to limit the distance to which the said stem can be inserted.

3. The protector of claim 1 wherein the cup is circular in bottom plan and said handle is circular in cross section and concentric with said circular cup.

4. The protector of claim 3 wherein said cup has a domed upper end through which said mouth opens and a side wall flaring from said domed end to said bottom edge.

5. The protector of claim 3 including a bead around the bottom edge of said cup.

6. The protector of claim 1 wherein the cup is plastic and of one piece with said handle.

7. The protector of claim 1 wherein said cup is imperforate.

8. The cup of claim 1 wherein the handle projects from said mouth axially to end short of said bottom edge, whereby said cup can be placed with its bottom edge on a flat surface without rocking.

9. A hand protector comprising an inverted cup, open at a bottom edge, of a size to admit a hand, a handle within the compass of said cup, said handle being of a size to be grasped by said hand, said handle being hollow through at least a portion of its length, having a closed part and an open part with a mouth opening through a top part of said cup, and a plug of pliable material in said mouth, said pliable material being of a consistency and axial length such as to receive and removably to hold the stem of a pyrotechnic device, said cup being circular in bottom plan and said handle being circular in cross section and concentric with said circular cup, said cup having a domed upper end through which said mouth opens and a side wall flaring from said domed end to said bottom edge, said handle tapering convergently from said open mouth toward a closed end.

10. A hand protector comprising an inverted cup, open at a bottom edge, of a size to admit a hand, a handle within the compass of said cup, said handle being of a size to be grasped by said hand, said handle being hollow through at least a portion of its length, having a closed part and an open part with a mouth opening through a top part of said cup, and a plug of pliable material in said mouth, said pliable material being made from a moldable putty and being of a consistency and axial length such as to receive and removably to hold the stem of a pyrotechnic device, said cup having a domed upper end through which said mouth opens and a side wall flaring from said domed end to said bottom edge said handle tapering convergently from said open mouth toward a closed end, said cup being formed of plastic and of one piece with said handle, said handle projecting from said mouth axially to end short of said bottom edge, whereby said cup can be placed with its bottom edge on a flat surface without rocking.

11. The protector of claim 10 wherein the bottom edge has three feet, spaced on the order of 120 degrees apart, to define a plane.

12. The protector of claim 10 wherein said handle has a stop axially spaced from said mouth, to limit the distance to which the stem can be inserted.

13. The protector of claim 12 wherein the wall thickness of the cup and handle is substantially uniform, and the stop is a plug of solid material secured within said handle.

14. A hand protector comprising an inverted, substantially rigid cup, open at a bottom edge, of a size to admit a hand, a handle within the compass of said cup, said handle being of a size to be grasped by said hand, said handle being hollow through at least a portion of its length, having a closed part and an open part with a mouth opening through a top part of said cup, and holding means in said mouth, securely but selectively manually removably to hold the stem of a pyrotechnic device.

* * * * *